US009181651B2

(12) United States Patent
Bishop

(10) Patent No.: US 9,181,651 B2
(45) Date of Patent: Nov. 10, 2015

(54) HAND-HELD CLOTHING IRON

(71) Applicant: Susan Bishop, Brooksville, FL (US)

(72) Inventor: Susan Bishop, Brooksville, FL (US)

( * ) Notice: Subject to any disclaimer, the term of this patent is extended or adjusted under 35 U.S.C. 154(b) by 37 days.

(21) Appl. No.: 14/148,777

(22) Filed: Jan. 7, 2014

(65) Prior Publication Data

US 2015/0191865 A1 Jul. 9, 2015

(51) Int. Cl.

| | |
|---|---|
| ***D06F 71/34*** | (2006.01) |
| ***D06F 71/36*** | (2006.01) |
| ***D06F 75/18*** | (2006.01) |
| ***D06F 75/38*** | (2006.01) |
| ***D06F 71/02*** | (2006.01) |
| *A47G 25/72* | (2006.01) |

(52) U.S. Cl.

CPC ..... *D06F 71/026* (2013.01); *D06F 71/34* (2013.01); *D06F 71/36* (2013.01); *D06F 75/18* (2013.01); *D06F 75/38* (2013.01); *A47G 25/72* (2013.01)

(58) Field of Classification Search

CPC ..... D06F 71/32; D06F 71/34; D06F 71/36; D06F 75/24; D06F 75/26; D06F 75/38; D06F 75/18; A45D 2/36; A45D 2/367; A45D 1/02; A45D 1/04; A45D 1/06; A45D 1/08; A45D 1/28; A47G 25/72

USPC ..... 38/25, 36, 71, 77.83, 93, 21; 132/223, 132/224, 225, 228, 232, 263, 266; 219/222, 219/225

See application file for complete search history.

(56) References Cited

U.S. PATENT DOCUMENTS

| | | | | |
|---|---|---|---|---|
| 563,494 | A * | 7/1896 | Kuechel | 132/224 |
| 2,243,061 | A * | 5/1941 | Lamia | 38/71 |
| 2,748,511 | A | 6/1956 | Pezza | |
| 2,807,896 | A * | 10/1957 | Tay | 38/77.83 |
| 3,449,846 | A | 6/1969 | Bricker | |
| 3,577,859 | A | 5/1971 | Davidson | |
| 3,703,042 | A | 11/1972 | Smith | |
| 4,219,724 | A | 8/1980 | Allvin | |
| 4,739,151 | A | 4/1988 | Smal | |
| 4,845,868 | A * | 7/1989 | Tierney et al. | 38/71 |
| 4,998,360 | A | 3/1991 | Lee | |
| 5,223,694 | A | 6/1993 | Tsuji | |
| 6,191,387 | B1 | 2/2001 | Smal | |
| 7,121,024 | B1 | 10/2006 | Clevenberg | |
| 7,989,734 | B2 * | 8/2011 | Lee | 219/222 |
| 8,375,609 | B2 * | 2/2013 | Harrington | 38/77.83 |
| 8,789,539 | B2 * | 7/2014 | Linglin et al. | 132/224 |
| 2009/0260650 | A1 * | 10/2009 | Jung | 132/224 |
| 2010/0089413 | A1 | 4/2010 | Wright | |
| 2011/0271564 | A1 | 11/2011 | Artinian | |
| 2012/0291797 | A1 * | 11/2012 | deGrood et al. | 132/211 |

* cited by examiner

*Primary Examiner* — Ismael Izaguirre

(74) *Attorney, Agent, or Firm* — Larson & Larson, P.A.; Justin P. Miller; Patrick A. Reid

(57) ABSTRACT

A hand-held clothing iron that solves the problems of the prior art by providing a clamping iron that is used on an article of clothing while it remains hanging, including the ability to apply disparate levels of heat to different sections of the clothing to provide the ideal temperature for each section.

13 Claims, 2 Drawing Sheets

HAND-HELD CLOTHING IRON

FIELD

This invention relates to the field of irons.

BACKGROUND

Clothing irons, also known as flatirons or merely irons, are devices used to press clothing to remove wrinkles and creases. Such irons were originally heated using hot coals, but are now more commonly heated using electricity.

But the process of using a household iron is time-consuming, requiring one to remove clothing from its hanger, locate an ironing-board, position the clothing with the portion to be ironed on a flat portion of the board, and finally iron the clothing. This is time-consuming at home, only made worse when traveling. Furthermore, a typical iron requires a large heated plate because a small plate does not provide a stable base for the iron.

The result is that ironing specific sections of an article of clothing is difficult, often requiring the use of different parts of the ironing board to iron different sections of an article of clothing.

What is needed is a low-weight iron that can be used on clothing while it remains hanging, allowing a user to iron specific parts of the clothing without creating creases in unwanted parts.

SUMMARY

The hand-held clothing iron solves the problems of the prior art by providing a clamping iron that is used on an article of clothing while it remains hanging.

Furthermore, the hand-held iron is not limited to applying a single level of heat across its entire surface, but is rather divided into zones.

The first zone is the gather-gap, where clothing is gathered/folded to allow the hand-held iron to reach sections of the article of clothing that are further away than its throat is long.

Past the gather-gap, the pairs of plates are divided into two or more zones, allowing for two or more levels of heating to be applied to the article of clothing. The plates are separated from one another by an insulating material, such as a ceramic. Or the plates are separated merely by an air-gap, the air-gap being of sufficient width to minimize heat transfer. The result of the insulator is to minimize heat transfer between the neighboring plates.

While the use of two pairs of plates is discussed herein, the use of three or more pairs of plates is anticipated.

The benefits of the gather-gap and the multi-zone heating are numerous.

First, the hand-held iron can reach sections of the article of clothing that are further away than the hand-held iron is long, without applying heat to the near portions. The result is fewer creases, without requiring a very long hand-held iron.

Second, the hand-held iron can iron disparate adjacent materials, applying the appropriate level of heat for each material. For example, a high-temperature setting for cotton and a low-temperature setting for synthetic material. Example heat settings include:

Linen: 445° F.
Cotton: 400° F.
Wool: 300° F.
Polyester: 300° F.
Silk: 300° F.
Lycra/Spandex: 275° F.

Third, if the gather-gap is full of material, and the material to be ironed is still outside of the reach of the near pair of plates, the hand-held iron can still iron distant material without creating creases by leaving the plates adjacent to the gather-gap at ambient temperature, only heating a further set of plates. Such a set-up creates additional reach for the hand-held iron.

The plates are made of a material with a high coefficient of heat transfer, e.g., steel, copper, aluminum, and optionally coated with an anti-static material and/or anti-friction coating, such as Teflon.

The dials used to choose from the multiplicity of heat settings include indications of which heat settings are appropriate for which materials. For example, indications of a heat setting of 1 for synthetics, 2 for silk/wool, and 3 for linen/cotton.

The housing is constructed of a material with a low coefficient of heat transfer to prevent the hot plates from warming the housing and burning the user.

The hand-held iron is anticipated to be powered by household current, although it is anticipated that battery power is possible. If powered by household current, the electrical cord is mounted to the hand-held iron by a swivel, resulting in a cord that is unlikely to tangle.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
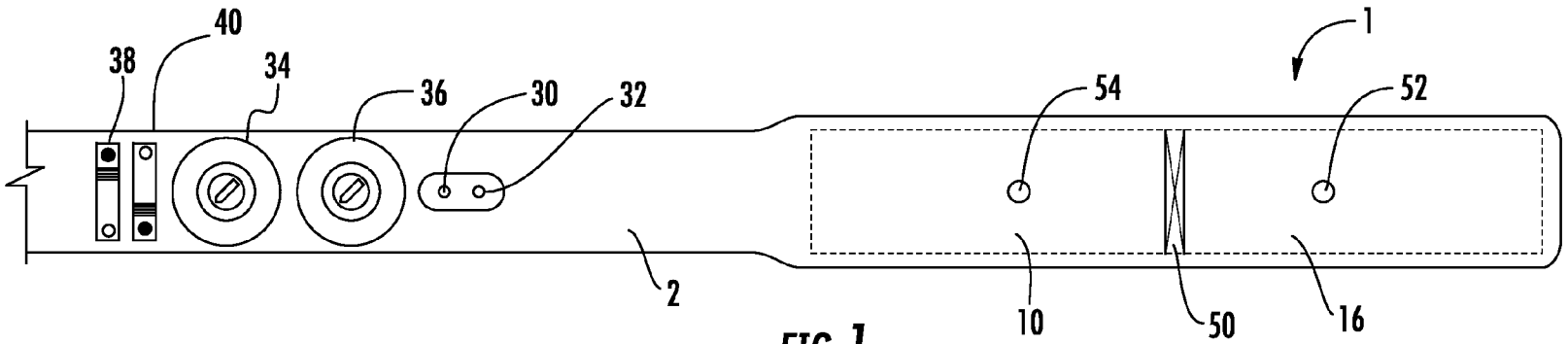
FIG. 1 illustrates a top view of a first embodiment.

Reference will now be made in detail to the presently preferred embodiments of the invention, examples of which are illustrated in the accompanying drawings. Throughout the following detailed description, the same reference numerals refer to the same elements in all figures.

Referring to FIG. 1, a top view of the first embodiment of the hand-held iron 1 is shown. The hand-held iron 1 includes a first housing member 2 and a second housing member 4, each made of a material with a low coefficient of heat transfer to maintain a cool housing.

First plate pair 10 is shown separated from second plate pair 16 by first insulator 20. First indicator light 30 is lit when first plate pair 10 is energized, and second indicator light 32 is lit when second plate pair 16 is energized.

Alternatively, the indicator lights 30/32 may be lit depending not on whether the plates are energized, but whether the plates are above a specified temperature. For example, if the plates 10/16 are hot enough to burn the user.

First temperature control 34 sets the temperature for first plate pair 10, and second temperature control 36 sets the temperature for second plate pair 16.

First power switch 38 energizes first plate pair 10, and second power switch 40 energizes second plate pair 16.

Figure 2:
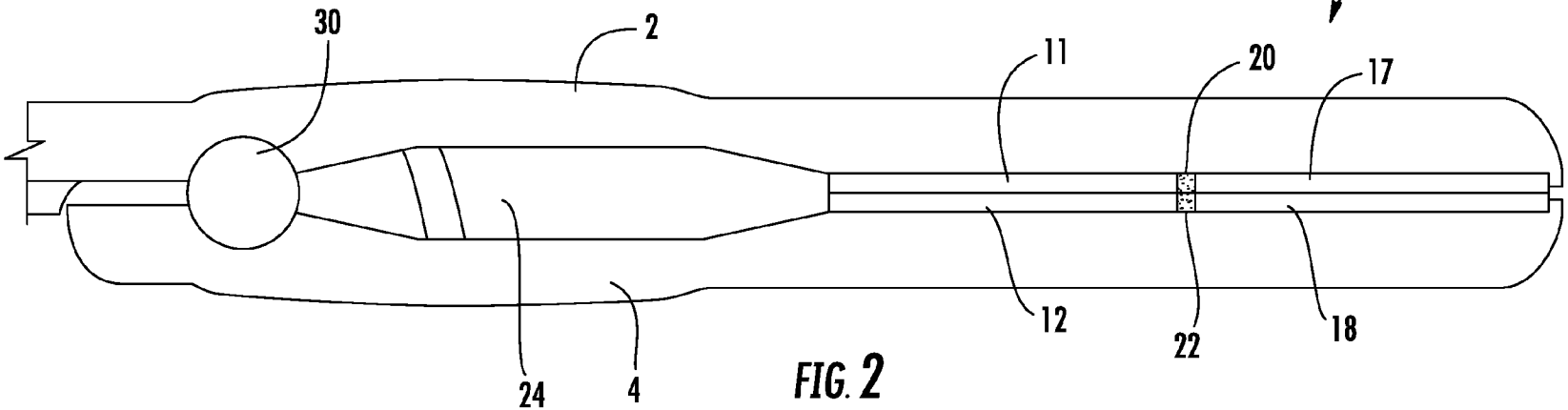
FIG. 2 illustrates a side view of the first embodiment.

Referring to FIG. 2, a side view of the first embodiment of the hand-held iron is shown. Here, it is shown that first plate pair 10 is made of two separate plates, Plate-1*a* 11 and Plate-1*b* 12. Furthermore, second plate pair 16 is shown as made of two separate plates, Plate-2*a* 17 and Plate-2*b* 18. Plate-1*a* 11 is separated from Plate-2*a* by first insulator 20. Plate-1*b* 11 is separated from Plate-2*b* by second insulator 20.

There is no requirement of limiting the plates to only two pairs. Additional pairs may be added, either increasing the length of the hand-held iron, changing the relative length of one pair of plates as compared to another, or increasing the quantity of divisions.

Gathering gap 24 is shown, and as indicated is between the plates 11/12/17/18 and the hinge 26. The hinge 26 allows the plates to be separated for the introduction of material, and subsequently closed upon the material.

While ironing a garment, it is helpful to identify to the user the location of the respective plates. Thus, a plate separation indicator 50 is provided on the first housing member 2, and optionally on the second housing member 4. The plate separation indicator may be raised portion of the housing member 2/4, an applied label, a disparate color of material, a light, or other type of indicator. The intention is to allow the user to visually identify the location of insulators 20/22 without requiring rotation of the hand-held iron 1 to view it from the side.

Similarly, it may be helpful to the user to identify which plates 10/16 are heated. This is accomplished through the optional first auxiliary indicator light 52 and second auxiliary indicator light 54. First auxiliary indicator light 50 is lit when first plate pair 10 is energized, and second auxiliary indicator light 52 is lit when second plate pair 16 is energized.

All indicator lights 30/32/52/54 may be of multiple types: simple on/off; color-switching (e.g., red for off and green for on); or color changing (e.g., blue for cool, yellow for warm, orange for warmer, red for hot).

Figure 3:
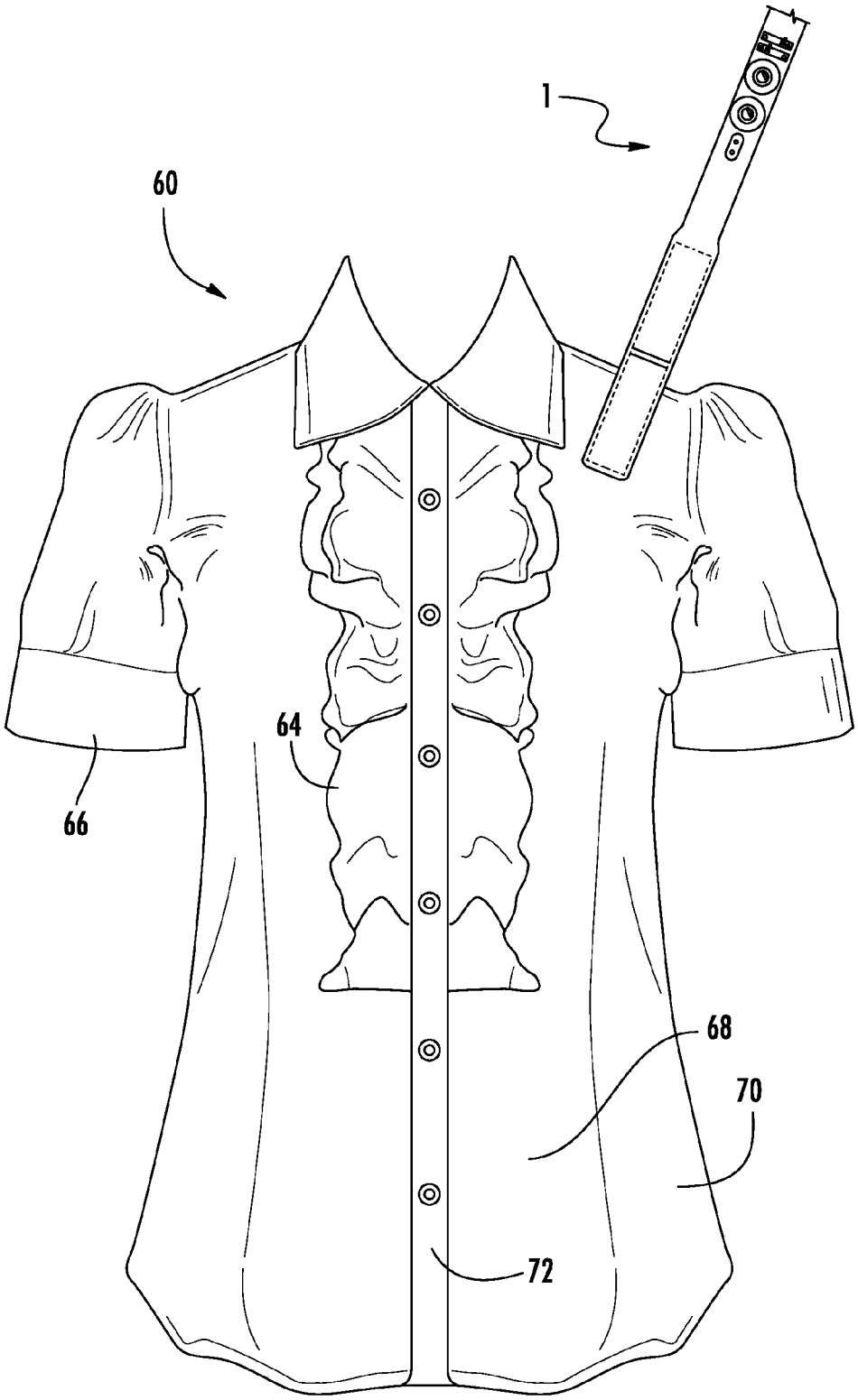
FIG. 3 illustrates a view illustrating the first embodiment ironing an exemplary hanging garment.

Referring to FIG. 3, an exemplary view of the first embodiment of the hand-held iron pressing an exemplary hanging garment is shown.

A discussion of specific uses for the hand-held iron 1 illuminates its versatility. An exemplary blouse 60 is shown. The hand-held iron 1 is small enough to be used on the collar 62 of the blouse 60 without needing to remove the blouse 60 from its hanger. Ruffles 64 can be ironed without having to unbutton the blouse 60, or to lay it on a flat surface, as can cuffs 66. A user may even reach through the separates created by buttons 72 and iron two disparate materials, such as first material 68 and second material 70. In the process the hand-held iron allows for the application of the ideal amount of heat for each material, all without requiring an ironing board, or an iron to heat up/cool down when moving from one material to another.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A clothing iron comprising:

a. a first pair of opposing heating plates;

b. a second pair of opposing heating plates;

c. the first pair of opposing heating plates separated from the second pair of opposing heating plates by an insulator; and d. a housing enclosing the first pair of opposing heating plates and second pair of opposing heating plates, the housing including one or more location indications of the first pair of opposing heating plates and second pair of opposing heating plates.

2. The clothing iron of claim 1, further comprising a hinge, the hinge allowing separation of the first pair of opposing heating plates and separation of the second pair of opposing heating plates.

3. The clothing iron of claim 2, further comprising a gather gap, the gather gap being a widened area between the hinge and the first pair of opposing heating plates wherein fabric may be accumulated.

4. The clothing iron of claim 1 further comprising a first indicator light for the first pair of opposing heating plates and a second indicator light for the second pair of opposing heating plates.

5. The clothing iron of claim 4, wherein the first indicator light is lit when the first pair of opposing heating plates is powered, and the second indicator light is lit when the second pair of heating plates is powered.

6. The clothing iron of claim 4, wherein the first indicator light is lit when the first pair of opposing heating plates is above a specified temperature, and the second indicator light is lit when the second pair of heating plates is above the specified temperature.

7. A hand-held iron comprising a. a first housing member and a second housing member connected by a hinge;

b. the first housing member having two or more upper heating plates, the upper heating plates separated by a first insulator;

c. the second housing member having two or more lower heating plates, the lower heating plates separated by a second insulator;

d. wherein the hinge acts to increase and decrease distance between the upper heating plates and lower heating plates; and e. wherein the first housing member includes one or more indications delineating the location of the first insulator.

8. The hand-held iron of claim 7, further comprising a gather gap, the gather gap being a widened area between the hinge and upper heating plates and lower heating plates, wherein fabric may be accumulated.

9. The hand-held iron of claim 7 further comprising a first indicator and a second indicator, wherein the two or more upper heating plates includes a first heating plate and a second heating plate and, the first indicator lit when the first heating plate is energized, the second indicator lit when the second heating plate is energized.

10. The hand-held iron of claim 7 further comprising indicator lights, the indicator lights lit to indicate temperature measurements of the upper heating plates in excess of a specified temperature.

11. A hand-held iron including a housing, two or more temperature controls, two or more heat indicators, and two housings connected by a hinge, further comprising:

a. a first pair of opposing heating plates;

b. a second pair of opposing heating plates;

c. the first pair of opposing heating plates separated from the second pair of opposing heating plates by an insulator; and d. wherein the first housing member includes one or more indications delineating the location of the insulator.

12. The hand-held iron of claim 11, further comprising a gather gap, the gather gap being a widened area between the hinge and upper heating plates and lower heating plates, wherein fabric may be accumulated.

13. The hand-held iron of claim 11, wherein the color of heat indicator for the first pair of opposing heating plates is based upon color, being:

a. blue for a temperature below 150 degrees Fahrenheit, b. yellow for a temperature at or above 150 degrees Fahrenheit and below 275 degrees Fahrenheit, c. orange for a temperature at or above 275 degrees Fahrenheit and below 400 degrees Fahrenheit, and d. red for a temperature at or above 400 degrees Fahrenheit.

* * * * *